US005538072A

United States Patent [19]

Burkhart et al.

[11] Patent Number: 5,538,072

[45] Date of Patent: Jul. 23, 1996

[54] METHOD FOR PREVENTING OVERSHOOT DURING HEAT PUMP DEFROST USING MEMORIZED SUPPLEMENTAL HEATER CAPACITY FROM PREVIOUS DEFROST CYCLE

[75] Inventors: Larry J. Burkhart, Indianapolis; Larry D. Burns, Danville, both of Ind.

[73] Assignee: Carrier Corporation, Syracuse, N.Y.

[21] Appl. No.: 335,677

[22] Filed: Nov. 8, 1994

[51] Int. Cl.[6] ..... F25B 29/00

[52] U.S. Cl. ..... 165/1; 165/12; 165/29; 62/160; 237/2 B; 219/486

[58] Field of Search ..... 165/1, 12, 29; 62/160; 237/2 B; 219/486

[56] References Cited

U.S. PATENT DOCUMENTS

| | | | |
|---|---|---|---|
| 4,292,813 | 10/1981 | Paddock | 165/12 |
| 4,335,847 | 6/1982 | Levine | 165/12 |
| 4,353,409 | 10/1982 | Saunders et al. | 165/29 |
| 4,356,962 | 11/1982 | Levine | 165/12 |
| 4,725,001 | 2/1988 | Carney et al. | 165/12 |
| 4,759,498 | 7/1988 | Levine et al. | 165/12 |
| 5,332,028 | 7/1994 | Marris | 165/29 |

*Primary Examiner*—John K. Ford

[57] ABSTRACT

A method of controlling a current defrost cycle for an outdoor coil of a heat pump system, the heat pump system having a plurality of supplemental heating elements for heating an air stream passing from an indoor coil to an air supply duct during defrost operation, wherein an initial quantity of supplemental heating elements energized is a function of a most recent previous defrost cycle. The method has the steps of: energizing the initial quantity of supplemental heating elements upon initiation of a defrost cycle; determining whether the initial quantity of supplemental heating elements provided is excessive; deactivating at least one of the supplemental heating elements if the initial quantity of supplemental heating elements being provided is excessive; determining whether the initial quantity of supplemental heating elements provided is insufficient; activating, if the initial quantity of supplemental heating elements being provided is insufficient, at least one additional supplemental heating element if the element is available; and retaining information as to an initial quantity of supplemental heating elements to be activated for a following defrost cycle, wherein the initial quantity of supplemental heating elements to be activated for a following defrost cycle is equal to a number of supplemental heating elements activated upon termination of the current defrost cycle.

14 Claims, 3 Drawing Sheets

METHOD FOR PREVENTING OVERSHOOT DURING HEAT PUMP DEFROST USING MEMORIZED SUPPLEMENTAL HEATER CAPACITY FROM PREVIOUS DEFROST CYCLE

BACKGROUND OF THE INVENTION

1. Field of the Invention

This invention relates generally to heat pump systems and, more particularly, to a method for controlling supplemental electric heat during the process of defrosting the outdoor coil thereof, so as to prevent overshoot and maximize heat pump efficiency.

1. Description of the Prior Art

During operation of a conventional heat pump in the heating mode, the outdoor coil acts as an evaporator. This means that the refrigerant in the outdoor coil is at a lower temperature than the ambient air, as it must be in order to transfer heat from the ambient air to the refrigerant by way of the outdoor coil. Under commonly occurring ambient conditions, the medium—almost always air—which is in a flowing heat transfer relationship with the evaporator, has its temperature lowered below its dew point. This causes condensation to develop on the coil, resulting in the formation of frost or, if the ambient temperature is sufficiently low, ice on the outdoor coil. Because the temperature of the refrigerant in the coil is lower than that of the ambient air, ice formation may occur even at ambient temperatures above the freezing point.

The presence of ice or frost decreases the efficiency of the heat exchanger and, in turn, the efficiency and capacity of the entire system. This results in a drop of the temperature of the air supplied to the conditioned space, potentially to an uncomfortable level. It is thus desirable, if not essential, to eliminate the frost or ice from the surface of the evaporator. This is accomplished by periodically running a defrost cycle.

Again, conventionally, the outdoor coil is defrosted by reversing the refrigerant flow so that the outdoor coil functions as a condenser rather than an evaporator. The heated refrigerant gas in the outdoor coil serves to melt the ice that had been formed thereupon. When the outdoor coil serves as a condenser the indoor coil, correspondingly, serves as an evaporator, and the refrigerant removes heat from the air being blown across the indoor coil. This results in air that is at a greatly reduced temperature being returned to the conditioned space, an undesirable phenomenon known as "cold blow".

One way of dealing with the "cold blow" phenomenon is to provide electric resistance heater elements in the supply air stream, which are energized during the defrost cycle in order to provide supplemental heat to the conditioned space. If, however, insufficient heat is provided to overcome the system's cooling capacity "cold blow" still occurs. On the other hand, if too much heat is provided by the supplemental heaters, the supply air temperature will become high enough to satisfy the indoor thermostat, the defrost cycle will be incomplete, and, with ice still blocking the exchange between the outdoor coil and air, system efficiency is compromised. This condition is known as "overshoot".

In a prior art invention, U.S. Pat. No. 5,332,028 to Derrick A. Marris assigned to a common assignee, the system was provided with a plurality of units capable of providing supplemental heat, so that the amount of supplemental heat provided could be staged. The teachings of the U.S. Pat. No. 5,332,028 are herein incorporated by reference as these teachings relate to heat provision during the defrost mode. In this prior invention, provision was made for sensing the temperature of the air being supplied to the conditioned space and responsively turning on an appropriate number of supplemental heat units to achieve the correct stage of supplemental heating. In this system each defrost cycle was individually handled—that is the number of heating stages needed in the previous defrost cycle had no effect on the current defrost cycle. If, for example, all the supplemental heating units had been used during the previous defrost cycle, the system still had to add one stage at a time until sufficient, but not excessive, heat was provided.

Since defrost cycles can occur with a frequency such that little change in ambient conditions may be expected from cycle to cycle, it is desired to provide a method for having the current number of supplemental heating unit energized depend upon the number of such units needed in the most recent previous cycle and the duration of the cycle. This allows the estimated correct amount of number supplemental heating units to be activated upon entering the defrost mode, tends to eliminate both cold blow and overshoot, and increases the efficiency of the system.

Furthermore, when an overshoot condition does occur wherein the room thermostat is satisfied but the defrost is not complete, it is preferable to provide a lowered level of supplemental heat until the defrost is completed, rather than terminating the heating cycle after only a partial defrost.

SUMMARY OF THE INVENTION

It is therefore a primary object of the present invention to provide a method for increasing the operating efficiency in a heat pump.

It is a further object of this invention to provide a method for handling overshoot conditions during the defrost operation of a heat pump.

It is still a further object of this invention to adjust the amount of supplemental heat provided during a current defrost cycle depending upon the conditions of the most recent defrost cycle.

It is yet another object of this invention to decrease the amount of supplemental heat provided in a current defrost cycle in comparison with the most recent defrost cycle if overshoot occurred during the most recent defrost cycle.

It is still another object of this invention to increase, if possible, the amount of supplemental heat provided in a current defrost cycle in comparison with the most recent defrost cycle if no overshoot occurred and primary heating resumed immediately upon termination of defrost.

It is yet a further object of this invention to provide the same amount of supplemental heat in a current defrost cycle in comparison with the most recent defrost cycle if no overshoot occurred and no primary heating was needed immediately upon termination of defrost.

It is still another object of this invention to provide heat to the conditioned space at a reduced level when the room thermostat is satisfied and defrost is not completed, such heat being provided until the defrost is completed.

These and other objects of the present invention are attained by a method of controlling a current defrost cycle for an outdoor coil of a heat pump system, the heat pump system having a plurality of supplemental heating elements for heating an air stream passing from an indoor coil to an air supply duct during defrost operation, wherein an initial quantity of supplemental heating elements energized is a function of a most recent previous defrost cycle. The method has the steps of: energizing the initial quantity of supplemental heating elements upon initiation of a defrost cycle; determining whether the initial quantity of supplemental heating elements provided is excessive; deactivating at least one of the supplemental heating elements if the initial quantity of supplemental heating elements being provided is excessive; determining whether the initial quantity of supplemental heating elements provided is insufficient; activating, if the initial quantity of supplemental heating elements being provided is insufficient, at least one additional supplemental heating element if the element is available; and retaining information as to an initial quantity of supplemental heating elements to be activated for a following defrost cycle, wherein the initial quantity of supplemental heating elements to be activated for a following defrost cycle is equal to a number of supplemental heating elements activated upon termination of the current defrost cycle.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
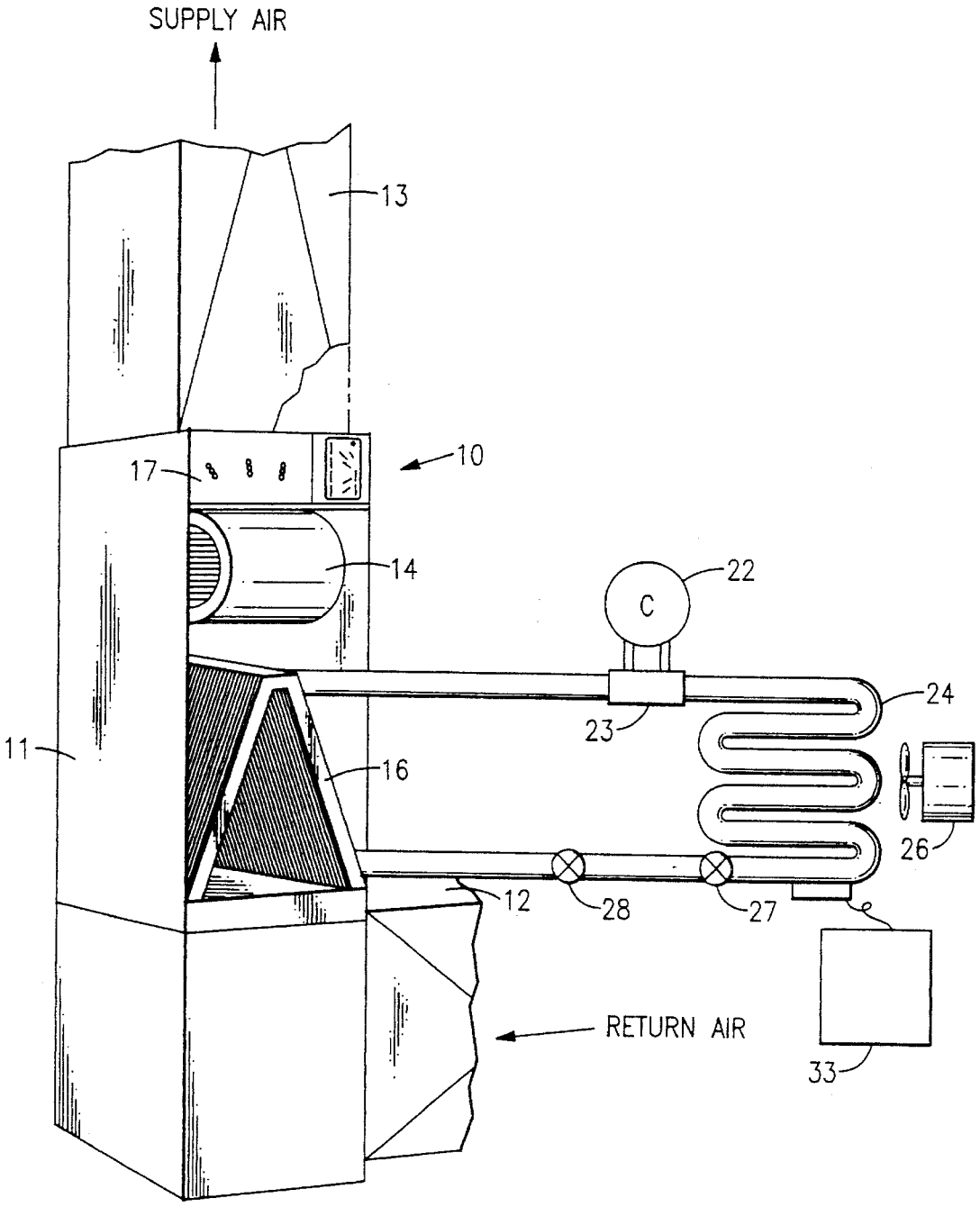
FIG. 1 is a pictorial representation of an indoor coil section of a heat pump system having the present invention incorporated therein.

Turning now to the Drawing and particularly, FIG. 1 thereof, the invention is shown generally at 10 as incorporated into an indoor coil section 11 having a return air plenum 12, a supply air plenum 13, and a blower motor assembly 14 for drawing the air into the return air plenum 12 and supplying it back to the space being conditioned via supply air plenum 13. Within the system is disposed indoor coil 16 which contains refrigerant which circulates therethrough for the purpose of cooling or heating the air passing thereover, depending on whether indoor coil 16 is used as an evaporator or condenser respectively.

Figure 2:
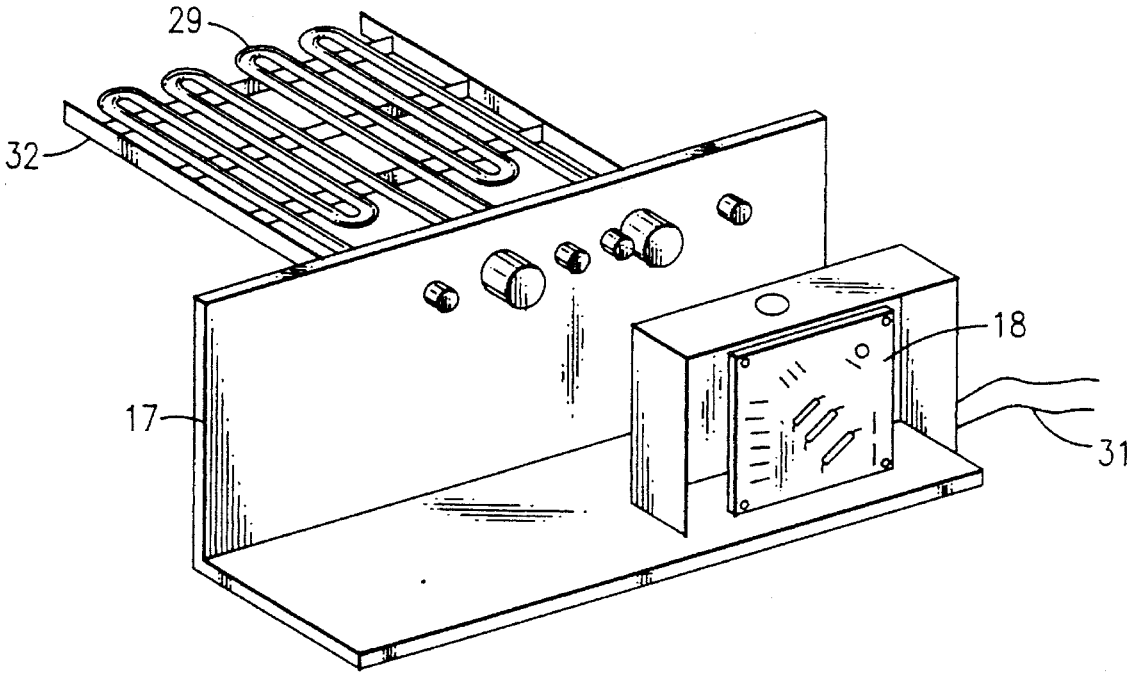
FIG. 2 is a perspective view of the electric heater portion of the invention of FIG. 1.

Downstream of the blower motor assembly 14, is located an electric heater module 17 having a number of electric resistance heater elements 29, shown in FIG. 2, wherein each heater element 29 can be independently energized so as to provide the desired level of supplemental heat to the conditioned space when heat is removed from the return air for the purpose of defrosting outdoor coil 24. The electric resistance heater elements 29 also may be used as second stage heat to supplement the heat pump during low outdoor temperature conditions.

A control assembly 18 operates to individually control the electric resistance heater elements 29 of electric heater module 17 and the blower motor assembly 14 in response to signals received from an indoor thermostat (not shown) and outdoor unit control 33. The defrost cycle is initiated by defrost initiation sequence of the outdoor unit defrost control assembly 33 in the heat pump. When initiated, the defrost control 33 in the outdoor unit switches the heat pump to the cooling mode without the outdoor fan motor being on. Simultaneously the defrost control 33 signals for the electric heat control 18 to be activated which, in turn, activates the auxiliary heat 29.

The indoor coil 16 is connected to a standard closed loop refrigeration circuit which includes a compressor 22, a 4-way valve 23, and outdoor coil 24, fan 26 and expansion valves 27 and 28. Outdoor unit defrost control assembly 33 selectively operates the 4-way valve 23 to direct operation in the cooling, heating, or defrost mode, with either expansion valve 28 metering the flow of refrigerant to indoor coil 16 or expansion valve 27 metering the refrigerant flow to outdoor coil 24. Outdoor unit defrost control assembly 33 also selectively operates the compressor 22 and the fan 26.

FIG. 2 shows the electric heater module 17 in greater detail. A plurality of electric resistance heater elements 29 (normally three, four or six elements) are connected via electric heat control assembly 18 to a pair of power leads 31. The heating elements 29 are typically 2, 5, or 10 W sized elements. They are connected to control assembly 18 in such a manner that they can be activated in stages. The heating elements 29 extend rearwardly into the supply air plenum 13 and are vertically supported by a plurality of support rods 32.

Figure 3:
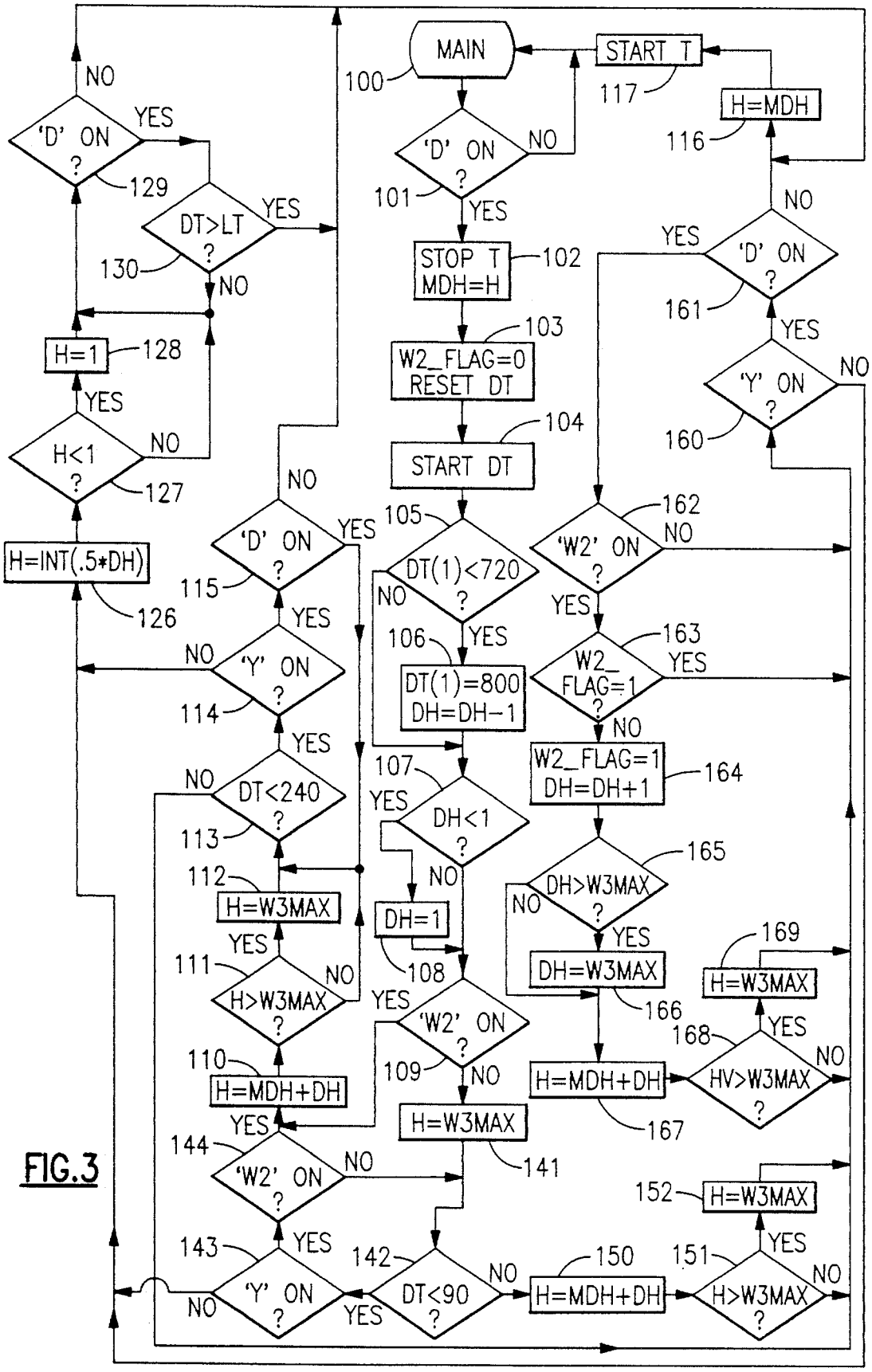
FIG. 3 is a flow chart depicting the steps involved in the preferred embodiment of the instant invention.

The steps involved in the preferred embodiment of this invention are shown in FIG. 3, wherein the electric heat control assembly 18 at a predetermined time will transfer control from the main control routine 100. A check in step 101 is made to determine if the system is in defrost mode (D). If it is not control will return to the main control routine 100. If the system is in defrost mode then the corresponding timer (T - which times the operation of the main program between defrost cycles) will be stopped and the supplemental heat (H) 17 will be energized at a level, MDH, determined from the previous defrost cycle, both in step 102. Although not shown, in the initial defrost cycle three levels or elements of heat are energized in three and four element model heat pumps and five levels are energized in six element heat pump models.

In step 103 the W2_FLAG is set to 0, indicating that a new defrost cycle has begun, and the timer which determines the length of time in defrost mode (DT) is reset to zero.

In step 104 the DT timer is started and then, in step 105 a determination is made as to whether the system overshoots in less than 12 minutes during and after the defrost mode during the previous cycle (DT(1) <720). Although in the preferred embodiment the value of 12 minutes is used, the range of time during which testing for overshoot takes place can be anywhere from under six to under sixteen minutes from the initiation of defrost. The value of DT(1) was assigned in the main control program and based on the value of DT when the defrost cycle was completed. If the system overshoots and spent less than 12 minutes in defrost mode during the prior cycle, then too high a level of supplemental heat was provided in the last cycle, and so in step 106 the value of DT(1) is set to 800 and DH, which corresponds to the number of supplemental heat elements 29 which will be activated, is decremented by one. Because supplemental heat is always needed when the system is performing the defrost cycle (due to the fact that primary heat is unavailable because of the nature of the defrost mode), DH will always be at least one. Thus, in either case, a determination is made in step 107 of whether DH is less than 1, if so it is set to 1 in step 108, and in either case step 109 follows.

In step 109 a determination is made as to whether there has been a supplemental heat call from the indoor thermostat ('W2' on). If there has, then in step 110 the value of H is set to the sum of MDH and DH, providing the supplemental heat needed. A determination is then made in step 111 as to whether H is greater than W3MAX—that is the total number of supplemental heater elements 29 available. If it is, then in step 112 the value of H is set to W3MAX. In either case in step 113 a determination is made as to whether DT has been on for less than 240 seconds—that is whether the system has been in defrost mode for less than four minutes. While the value of four minutes is used in the preferred embodiment, this time period can vary from between two and eight minutes.

If, in step 113 DT is less than 240 then a check is made in step 114 to determine if the indoor thermostat is still calling for primary heat ('Y' on). If it is, then a check is made in step 115 to see if the defrost mode is still on. If the defrost mode is on then control returns to step 113. Otherwise H is set to MDH in step 116, the timer T is started in step 117 and control returns to the main control process in step 100. The timer T is the main program clock and runs constantly except when the system is in defrost mode.

Thus if the call for primary heat continues and defrost is complete all within the first four minutes there will be no change to the amount supplemental heat at the initiation of the next defrost cycle.

If, on the other hand, the determination of step 114 indicates no indoor thermostatic call for primary heat, then in this case, and all other instances where control passes to step 126, there has been an overshoot and the level of supplemental heat needs to be lowered.

Thus, in step 126, H is set to the rounded down value of half of DH, tested in step 127 to see if this is less than 1 and if so set in step 128 to 1. In either case the system is tested in step 129 to see if it remains in defrost mode. If not step 116 follows.

If the system is in defrost mode in step 129, then the DT timer is tested in step 130 to see if it is greater than 660. The preferred time during which the system looks for overshoot is thus eleven minutes, but it could range from as little as five minutes to as much as fifteen minutes. If it is, then control passes to step 116 and if it is not to step 129. The outdoor control unit 33 will have terminated defrost in any case if it exceeds 10 minutes. However the process of the instant invention will continue monitoring for overshoot condition an additional minute after the defrost terminates, and if overshoot occurs reduce the number of electric heater modules 17 initially activated in the next defrost cycle. The locking of the heat pump on with half the supplemental heat added, until the defrost terminates, or eleven minutes have passed, is different from conventional systems where a cessation of the indoor thermostatic call for primary heat would result in the immediate termination of heat pump activity until the next call for heat.

Returning, now, to step 109, if there is no supplemental heat call from the indoor thermostat then in step 141 the value of H is set to W3MAX. A determination is then made in step 142 as to whether DT is less than 90. While the time period used in the preferred embodiment is 90 seconds it could range from 30 seconds to 4 minutes. If DT is less than 90, and a check in step 143 shows that the indoor thermostat is no longer calling for primary heat from the heat pump, then control passes to step 126. On the other hand if the indoor thermostat is calling for primary heat from the heat pump, then in step 144 a determination is made as to whether the thermostat is calling for supplemental heat. If it is then control goes to step 110, and if it is not, control returns to step 142. Thus, in the first minute and a half of defrost, the system awaits a call for supplemental heat until either it is issued or the call from primary heat is cancelled.

If, in step 142, the defrost timer shows a defrost time of greater than or equal to 90 seconds, then in step 150 H is set to MDH plus DH, and, in step 151, its value is tested to see if it exceeds W3MAX. If it does, then in step 152 it is set to equal W3MAX, and in either case the issuance of a call for primary heat is checked in step 160. If there is no call for primary heat from the indoor thermostat then the system is in overshoot condition and control is transferred to step 126.

If, on the other hand, the test of step 160 shows a call for primary heat, there is no overshoot. A check is made in step 161 to determine if the system is in defrost mode. If not then control passes to step 116 to prepare for return to the main control routine. If the defrost mode is active then in step 162 a determination is made as to whether there is a call for supplemental heat. If no such call exists, step 160 follows. If there is a supplemental heat call, then in step 163 the W2_FLAG is checked to see whether it is set (equal to 1); if so then this sub_cycle has been executed at least once since control left the main control routine and control returns to step 160. If not, then in step 164 W2_FLAG is set to 1 to indicate at least one execution of the sub_cycle for future reference and the value of DH is incremented to indicate that one more electric resistance heater element 29 is to be turned on both in the current defrost cycle and the next time defrost mode is entered. Thus the number of electric resistor elements 29 needed can only be incremented once during a given defrost cycle. The next steps check that this value does not exceed the total number of electric resistance heater elements 29. At step 165 DH is tested to see if it exceeds W3MAX. If it does, then in step 166 it is set back to W3MAX, and in either case H is set to the sum of MDH and DH in step 167, resulting in the proper number of electric resistance heater elements 29 being activated. In step 168 H is checked to see if it exceeds W3MAX and, if so, in step 169 H is set back to W3MAX. In either case control returns to step 160.

Thus if the call for primary heat is terminated before the defrosting operation is complete, that is overshoot has occurred, then one stage less of strip heat—that is one less electric resistance heater element 29 is activated upon initiation of the next defrost cycle. If the defrosting operation terminate normally, that is the call for primary heat continues and defrost is complete all, within the first four minutes there will be no change to the amount supplemental heat at the initiation of the next defrost cycle. If, on the other hand, the supplemental heat 17 is no longer needed when the defrost cycle completes, but primary heat is still called for by the thermostat, then an additional electric resistance heater element 29, if available, is energized upon initiation of the next defrost cycle.

While this invention has been explained with reference to the process disclosed herein, it is not confined to the details set forth and this application is intended to cover any modifications and changes as may come within the scope of the following claims:

What is claimed is:

1. A method of controlling a current defrost cycle for an outdoor coil of a heat pump system, the heat pump system having a plurality of supplemental heating elements for heating an air stream passing from an indoor coil to an air supply duct during defrost operation, wherein an initial quantity of supplemental heating elements energized is a function of a most recent previous defrost cycle, comprising the steps of:

energizing the initial quantity of supplemental heating elements upon initiation of a defrost cycle;

determining whether the initial quantity of supplemental heating elements provided is excessive;

deactivating at least one of the supplemental heating elements if the initial quantity of supplemental heating elements being provided is excessive;

determining whether the initial quantity of supplemental heating elements provided is insufficient;

activating, if the initial quantity of supplemental heating elements being provided is insufficient, at least one additional supplemental heating element if said element is available; and retaining information as to an initial quantity of supplemental heating elements to be activated for a following defrost cycle, wherein said initial quantity of supplemental heating elements to be activated for a following defrost cycle is equal to a number of supplemental heating elements activated upon termination of the current defrost cycle.

2. The process according to claim 1 comprising the additional step of determining whether the initial quantity of supplemental heating elements provided is neither excessive nor insufficient.

3. The process according to claim 2 wherein said step of determining whether the initial quantity of supplemental heating elements provided is neither excessive nor insufficient comprises determining if defrost is completed while both supplemental and primary heat are being requested and within a first predetermined time and, if so, then maintaining a same quantity of activated supplemental heating elements as the initial quantity.

4. The process according to claim 3 wherein said first predetermined time is between 120 and 480 seconds.

5. The process according to claim 4 wherein said first predetermined time is 240 seconds.

6. The process according to claim 1 wherein said step of determining whether the initial quantity of supplemental heating elements provided is excessive comprises determining if there is a call for supplemental heat without a call for primary heat.

7. The process according to claim 1 wherein said at least one additional supplemental heating element is a single supplementary heating element.

8. The process according to claim 1 wherein said step of determining whether the initial quantity of supplemental heating elements provided is excessive continues for a second predetermined time after defrost is terminated by an outdoor control.

9. The process according to claim 8 wherein said second predetermined time is between 30 and 240 seconds.

10. The process according to claim 9 wherein said second predetermined time is 90 seconds.

11. The process according to claim 1 where the step of determining whether the initial quantity of supplemental heating elements provided is insufficient comprises the steps of:

determining if a call for supplemental heat is issued within a predetermined time range, determining if a call for primary heat is maintained, and determining if the call for supplemental heat is maintained.

12. The process according to claim 11 wherein said predetermined time range is between 30 and 900 seconds.

13. The process according to claim 11 wherein said predetermined time range is between 90 and 660 seconds.

14. The process according to claim 1 wherein said at least one supplemental heating element being deactivated is a single supplemental heating element.

* * * * *